US006296175B1

(12) United States Patent
Dixon

(10) Patent No.: US 6,296,175 B1
(45) Date of Patent: Oct. 2, 2001

(54) TAMPER RESISTANT CONTAINER

(75) Inventor: Rodney D. Dixon, Burlington, NC (US)

(73) Assignee: MPC Packaging Corporation, Mebane, NC (US)

( * ) Notice: Subject to any disclaimer, the term of this patent is extended or adjusted under 35 U.S.C. 154(b) by 0 days.

(21) Appl. No.: 09/527,727

(22) Filed: Mar. 17, 2000

(51) Int. Cl.[7] ..... B65D 5/43

(52) U.S. Cl. ..... 229/102; 206/807; 229/125.26; 229/125.28

(58) Field of Search ..... 229/102, 125.26, 229/125.28, 149; 206/807

(56) References Cited

U.S. PATENT DOCUMENTS

| | | | | |
|---|---|---|---|---|
| 1,130,271 | * | 3/1915 | Hammond | 229/125.26 |
| 2,456,841 | * | 12/1948 | Rushing | 229/125.28 |
| 2,559,320 | * | 7/1951 | Rushing et al. | 229/125.26 |
| 3,326,447 | * | 6/1967 | Williamson | 229/125.28 |
| 3,642,193 | * | 2/1972 | Rada | 229/149 |
| 3,749,230 | | 7/1973 | Foster . | |
| 3,893,614 | | 7/1975 | Meyers . | |
| 4,126,224 | | 11/1978 | Laauwe et al. | 206/540 |
| 4,150,760 | | 4/1979 | d'Orgelys | 215/213 |
| 4,196,809 | | 4/1980 | Tonrey | 206/534 |
| 4,364,488 | | 12/1982 | Anjou | 220/281 |
| 4,401,210 | | 8/1983 | Anjou | 206/1.5 |
| 4,437,566 | | 3/1984 | Szahler | 206/1.5 |
| 4,535,929 | * | 8/1985 | Sherman, II et al. | 206/807 |
| 4,561,544 | | 12/1985 | Reeve | 206/540 |
| 4,730,731 | | 3/1988 | Allison | 206/540 |
| 4,741,433 | | 5/1988 | Irvine | 206/1.5 |
| 4,746,008 | | 5/1988 | Heverly et al. | 206/1.5 |
| 4,844,284 | | 7/1989 | Drozd et al. | 220/281 |
| 4,890,742 | | 1/1990 | Allison | 206/540 |
| 5,033,634 | | 7/1991 | Batchelor et al. | 220/281 |
| 5,040,722 | * | 8/1991 | Fromion et al. | 229/125.26 |
| 5,080,222 | | 1/1992 | McNary | 206/1.5 |
| 5,082,137 | | 1/1992 | Weinstein | 220/346 |
| 5,163,559 | | 11/1992 | Bunin | 206/532 |
| 5,180,072 | | 1/1993 | Oehlert | 215/209 |
| 5,205,477 | * | 4/1993 | Zimmermann | 229/125.28 |
| 5,443,202 | * | 8/1995 | Jorgensen-Beck et al. | 229/125.26 |
| 5,782,359 | | 7/1998 | McAllister et al. | 206/538 |
| 5,921,395 | | 7/1999 | Alexander | 206/538 |

* cited by examiner

*Primary Examiner*—Gary E. Elkins
(74) *Attorney, Agent, or Firm*—Womble Carlyle; Sandridge & Rice, PLLC; C. Robert Rhodes

(57) ABSTRACT

The present invention provides a solution with a releasable, childproof container that is particularly suited for ammunition and other hazardous items. The container has a cover and body. The container body includes, preferably in two opposing side walls, a resilient leaf, which is preferably biased slightly outward. The resilient leaf is adapted to pivot inwardly and outwardly within an opening in a side wall. The container cover includes stops mounted on an inner surface of the body side walls and aligned with the cover side wall having the resilient leaf. Adjacent to and above the stop is a release panel, which is also capable of pivoting inwardly and outwardly relative to the container.

16 Claims, 5 Drawing Sheets

TAMPER RESISTANT CONTAINER

BACKGROUND OF THE INVENTION (1) Field of the Invention

The present invention relates to child resistant containers for storage of hazardous materials, and in particular, child resistant containers for transferring and storing ammunition.

(2) Background of the Invention

Young children have a well-known tendency to place small objects in their mouths. In addition to swallowing, children often bang objects together or on hard surfaces. Such activity may lead to tragic results when ammunition is accidentally made accessible to children. Although efforts are generally made to keep boxes of ammunition out of reach from children, secondary lines of defense are needed. Further, access to ammunition may lead to efforts to actually load a weapon out of curiosity, which may also lead to tragic consequences.

Many child resistant containers have been devised for hazardous materials, such as ammunition and medicine. Opening these containers generally depends on some combination of dexterity, strength and intellect, which is not possessed by young children. In addition to being rather expensive to manufacture, these containers often turn out to be inconvenient and too difficult for adults to open. Many adults lack the strength and dexterity to open these containers for a variety of physical reasons. Further, given the nature of the contents, these containers need to provide periodic access and child resistance between periods of access.

There is a need for an inexpensive container that is child resistant while remaining accessible to adults of varying physical abilities. The container must have a reusable locking assembly. Preferably, the container would be easy to manufacture using traditional paperboard construction techniques.

SUMMARY OF THE INVENTION

The present invention provides a solution with a releasable, childproof container that is particularly suited for ammunition and other hazardous items. The container has a cover and body. The container body includes, preferably in two opposing side walls, a resilient locking leaf, which is preferably biased slightly outward. The resilient leaf is adapted to pivot inwardly and outwardly within an opening in a side wall. The container cover includes stops mounted on an inner surface of the body side walls and aligned with the cover side wall having the resilient leaf. Adjacent to and above the stop is a release panel, which is also capable of pivoting inwardly and outwardly relative to the container.

As the cover is lowered over and onto the container body, the stops force the resilient leaves inward. The resilient leaf releases outward after the stop travels completely below the resilient leaf, such that the stop is positioned directly below and in alignment with the corresponding resilient leaf. The cover and container body cannot be inadvertently separated from the fully closed position because upward travel of the cover relative to the body is interrupted by the stops contacting the corresponding resilient leaves. The cover is removed by initially pushing inwardly on the release panels so that the resilient leaves are moved inwardly to a position inside the stops. Once the resilient leaves and respective stops are clear of each other, the cover is released for removal. Preferably, the container box and cover are of paperboard box construction using corrugated cardboard wherein the cover and body are each formed from uniform templates.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which.

DESCRIPTION OF THE PREFERRED EMBODIMENT

Figure 1:
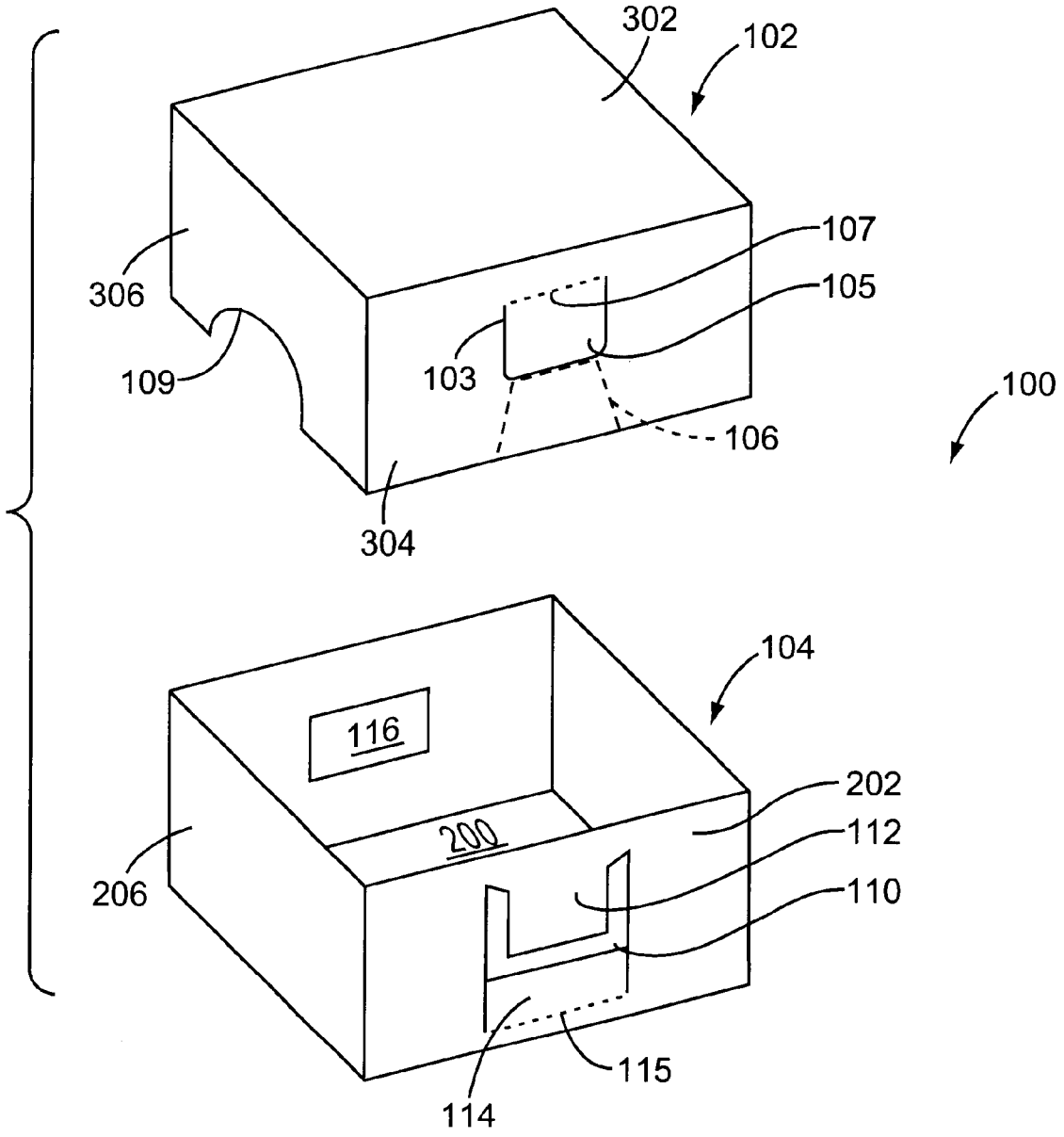
FIG. 1 is an exploded perspective view of a container according to the present invention.

Throughout the figures, fold lines are indicated by lines of long and short dashes. Cut lines along which the material has been cut along a surface or through completely are indicated by solid lines. With reference to FIGS. 1 and 4 and 4 through 8, a tamper resistant container according to the present invention includes a cover 102 having an inside surface 102*a* and outside surface 102*b* and a container body 104 on which the cover 102 fits.

The container cover 102 has a top panel or wall 302, opposing end walls 306 and side walls 304. The container cover 102 optionally includes finger cutouts 109 located at opposing end walls 306 of the cover 102. The cover side walls 304 each include a release panel 105 formed in and being substantially coplanar with the outside surface of the container cover 102. The release panels 105 are hingedly connected to the side walls 304 so as to be pivotable to either side of the side walls. Optionally, a score 107 may be provided in the container cover 102 to facilitate the hinge-like motion by the release panel 105 as described below. Preferably the score 107 is only along the outside surface and along the base of release panel 105. A stop 106 is mounted on the inner surface of the side walls 304 in a position adjacent to and, in a preferred embodiment, immediately below the release panel 105. Although the stop 106 is shown in this preferred embodiment as having a trapezoidal shape, other suitable shapes may be used.

The container body 104 has a floor 200, opposing end walls 206 and side walls 202 extending upwardly therefrom. Each of the side walls 202 includes a U-shaped cutout 110 which forms an opening 110 with a downwardly extending resilient locking leaf 112 therein. The cutout 110 should provide sufficient space surrounding resilient leaf 112 to permit the resilient locking leaf 112 to flex freely inwardly and outwardly in a coplanar relationship with side wall 202. Preferably, the resilient leaves 112 are biased slightly outward to enhance outward resiliency. This may be accomplished by simply bending the leaves outward to an extent that they stay outwardly biased in their resting state. Notably, the terms "side walls" and "end walls" are used solely to facilitate the description of the invention and avoid confusion. In practice, any elements located on or in the side walls are equally applicable to the end walls.

The container body 104 may optionally contain flap 114, which is hingedly formed in side wall 202. The width of flap 114, in this preferred embodiment, is equal to that of the opening 110. A slit 115 may be provided at the base of flap 114 to facilitate its hinge-like movement. The container cover 102 and body 104 may be constructed of any suitable material. The preferred material is corrugated EFLUT board. Other acceptable materials include thermoplastics or cardboard.

Figure 2:
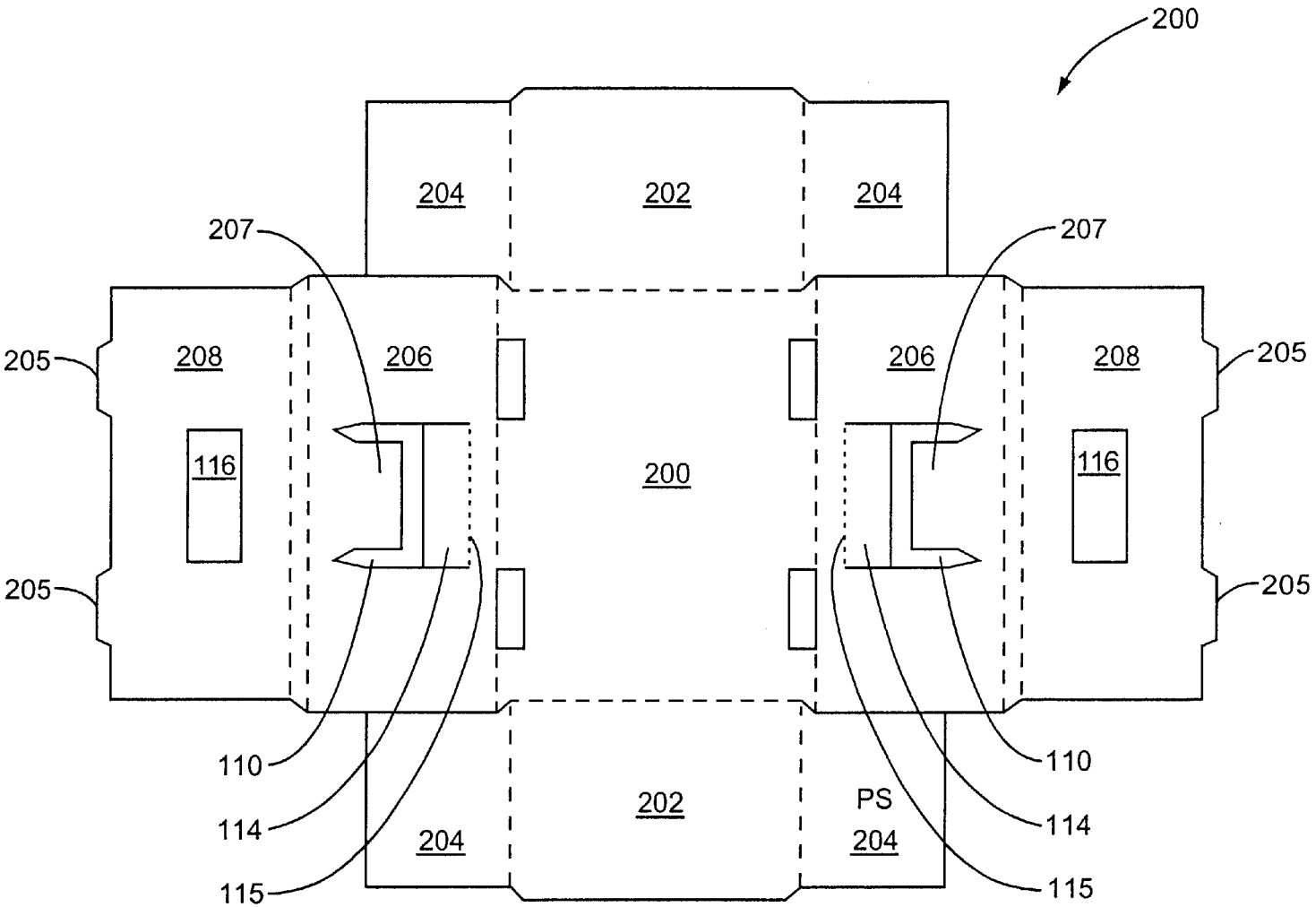
FIG. 2 is a top plan view of a blank for forming the cover of the container of the present invention.

Referring now to FIG. 2, an exemplary container body blank 200, includes a floor 201, end walls 202 extending from the ends of the floor 201 and side walls 206 extending from the sides of floor 200. Side walls 206 may include a fold-over portion 208 which, during the assembly of the container body is folded over onto side walls 206 so as to hold the end wall flaps 204 in place. In this embodiment, the fold over portions 208 are held in place by tabs 205 which are inserted into slots 207. It should be readily apparent to one of ordinary skill that the folded over portion 208 may be eliminated, for example, by adhering the end wall flaps 204 to the side walls 206. Opening 116 in fold over portions 208 allows resilient leaves 112 to travel through fold over portions 208 when assembled as discussed in further detail below.

Figure 3:
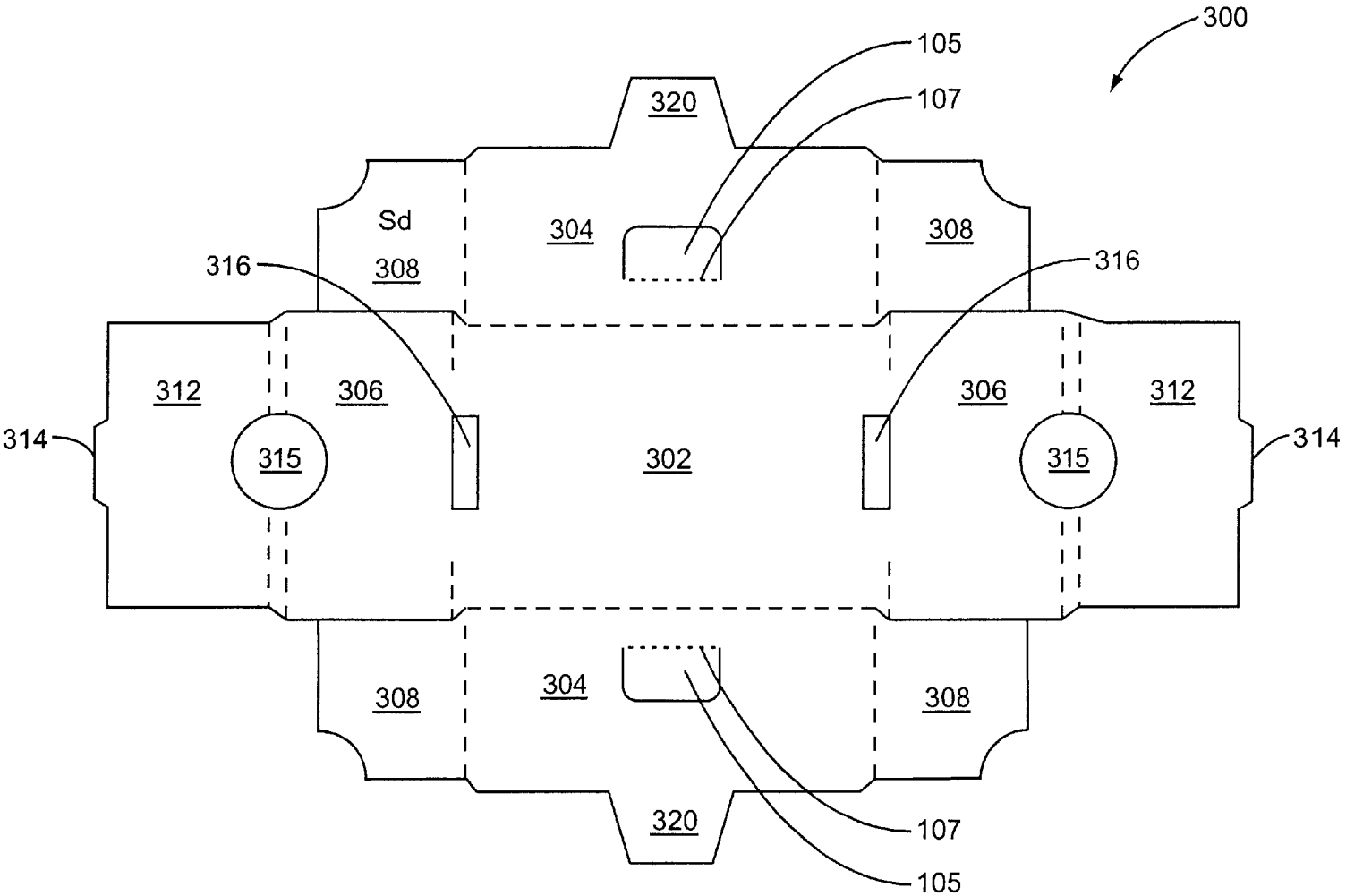
FIG. 3 is a top plan view of a blank for forming the body of the container of the present invention.

With reference to FIG. 3, an exemplary container cover blank 300 is illustrated. Cover blank 300 is preferably constructed of the same material as the blank 200 used to construct the container body. Cover blank 300 includes a top panel or wall 302, cover side walls 304, and in this embodiment, end walls 306 each of which include a folded-over portion 312. The end panels are provided with circular openings 315 that form finger cutouts when end panel portion 312 is folded over onto end panel portion 310 so as to hold side panel flaps 308 in place. In this embodiment, the folded over portions 312 are held in place by the insertion of tabs 314 into slots 316. In an alternative embodiment the folded over portion 312, tabs 314 and slots 316 are eliminated by gluing the side wall flaps 308 to the inner surfaces of end walls 306.

The stops 106 located on the side walls 304 are formed in this embodiment by folding over stop flaps 320. It will be readily apparent to one of ordinary skill in the art that rather than being formed integrally with the side walls 304, a separate stop member could be adhered or otherwise attached to the inner surface 102*a* of the side walls 304.

Figure 4:
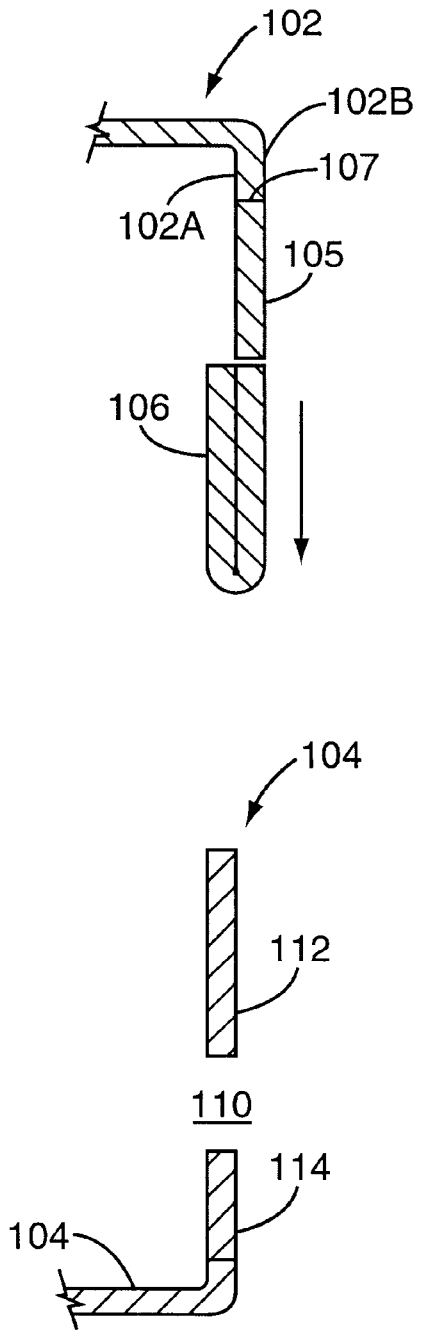
FIG. 4 is a partial sectional view taken along 4—4 in FIG. 1.

The operation of the tamper resistant mechanism of the present invention is illustrated in the cross-sectional views in FIGS. 4 through 8. Notably, the container cover 102 and body 104 are shown having a single wall construction for simplicity. If the templates of FIGS. 2 and 3 are used, the walls of the cover and body are double layered. FIG. 4 depicts the container cover 102 positioned directly above the container body 104. As noted above, a stop 106 is mounted on the inner surface 102A of each side wall 304 of the container cover 102. The inside dimensions of the container cover 102 are substantially equal the outside dimensions of the container body 104. The stops 106 infringe on these dimensions and, preferably, cause the top portions of side walls 202 of the container body 104 to flex inward when the container cover 102 begins to slide over the container body 104.

Figure 5:
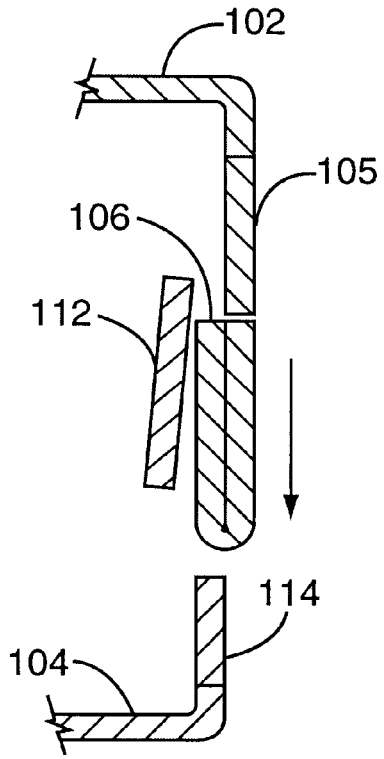
FIG. 5 is a partial sectional view showing the deflection of the resilient leaf by the stop mounted on the container cover during placement of the cover.
Figure 6:
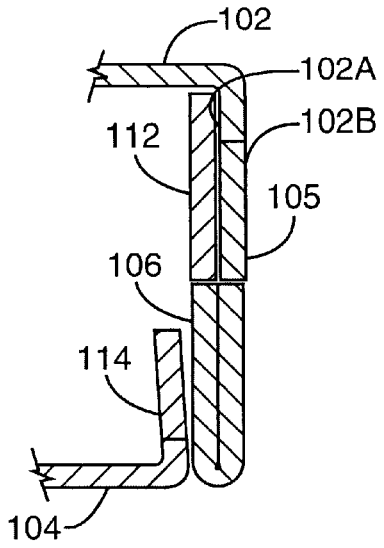
FIG. 6 is a partial sectional view showing the container body stop in its operative position adjacent to and beneath the resilient leaf after the resilient leaf has returned to its original position.

As depicted in FIG. 5, as the container cover 102 continues its descent over the container body 104, the stops 106 cause the resilient leaves 112 to hinge inward until the stop passes the respective lower edges of the resilient leaves 112. Once the stops 106 pass these lower edges, the resilient leaves 112 spring outward toward the respective inside surfaces 102A of side walls 304 of the container cover 102 and over top of stops 106, as depicted in FIG. 6. Notably, the optional flap 114 flexes inward in response to contact from the stops 106 to allow the stops 106 to rest further toward the inside of the container, which allows the lower edge of the resilient leaves 112 to further overlap the upper edges of the stops 106. Preferably, the resilient leaves 112 and stops 106 are in substantial vertical alignment once the cover is in place. The result is a locking action between the container cover 102 and body 104. In the preferred embodiment, container cover 102 and body 104 are configured to allow the upper edge of stops 106 and the lower edges of the resilient leaves 112 to rest substantially adjacent one another when the container cover 102 is in place.

Figure 7:
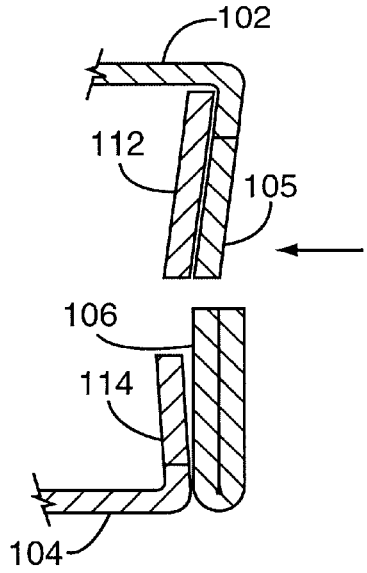
FIG. 7 is a partial sectional view showing the release panel in a deflected position so as to deflect the resilient leaf away from the container cover stop.
Figure 8:
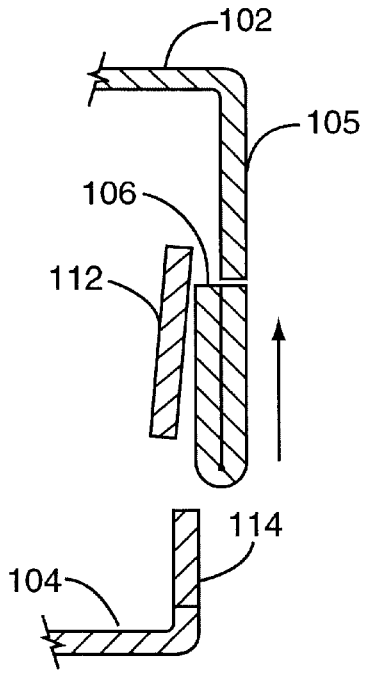
FIG. 8 is a partial sectional view showing the deflection of the resilient leaf by the stop mounted on the container cover during removal of the cover.

Once the cover is locked in place, release of the cover initially requires application of inwardly directed, lateral forces to the release panels 105 as depicted in FIG. 7. These forces must effectively cause the release panels 105 to hinge inwardly to an extent sufficient to contact and push the resilient leaves 112 past the most inner surfaces of the stops 106. For double wall construction, openings 116 (FIGS. 1 and 2) are provided in fold over portions to allow the resilient leaves 112 to hinge inwardly through the fold over portion. Once the resilient leaves 112 are clear of the stops 106, the container cover 102 will be slid off of the container body 104, as depicted in FIG. 8. Once the upper edge of stops 106 slide past the lower edges of the resilient leaves 105, inward lateral force to the release panels is no longer required for removal of the container cover 102.

Although numerous advantages of the present invention have been discussed, it will be appreciated by one of ordinary skill that other advantages are provided by the present invention. Those advantages, though not discussed here, are included within the scope of the present invention.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What is claimed is:

1. A releasable, lockable, container comprising:

(a) a body having a bottom panel and four upwardly extending body side walls;

(b) a cover having a top panel and four downwardly extending cover side walls sized to slide over said body wherein said side walls of said cover and body overlap once said cover is completely positioned on said body;

(c) a pair of opposing said body side walls each having formed therein a locking leaf having a free end hanging downward toward said bottom panel;

(d) a pair of opposing ones of said cover side walls each having formed therein a release panel having a free end extending away from said top panel and having formed on an inside surface a stop, wherein said release panel is between said stop and said top panel, and when said cover is completely on said body, said stop and said free end of said locking leaf lie substantially within a vertical plane to prevent removal of said cover from said body, and said release panel and said locking leaf are substantially, horizontally aligned such that when said release panel is deflected inward, said locking leaf is deflected inside of said stop to allow removal of said cover from said body.

2. The container of claim 1 wherein each of said pair of opposing body side walls further include a vertically extending (114) flap between said free end of said locking leaf and said bottom panel, said vertically extending flap capable of deflecting inward by said stop when said cover is completely on said body to allow better vertical alignment of said locking leaf and said stop.

3. The container of claim 2 further comprising horizontal slits along a base portion and on an outside surface each of said vertically extending flaps to provide greater flexibility of said vertically extending flaps.

4. The container of claim 2 further comprising horizontal slits along a base portion and on an outside surface of each said locking leaf to provide greater flexibility of said locking leaves.

5. The container of claim 1 wherein said pair of opposing body side walls each include a U-shaped slot that forms and defines said locking leaf.

6. The container of claim 1 wherein said pair of opposing cover walls each include a U-shaped cut that forms and defines said release panel.

7. The container of claim 1 further comprising tabs extending downward from each of said opposing cover side walls that are folded inward against said inside surface of said opposing cover side walls to form said stops.

8. The container of claim 1 wherein said body is completely formed by folding a unitary container blank.

9. The container of claim 1 wherein said cover is completely formed by folding a unitary container blank.

10. The container of claim 1 wherein said body and cover are made corrugated cardboard.

11. A paperboard container having a releasable locking mechanism comprising:

(a) a body having a bottom and side walls extending from said bottom to form an open-ended box, at least one of said side walls having a resilient locking leaf having a free end extending toward said bottom; and (b) a cover having a top and side walls extending from said top to form an open-ended box sized to slide over said body, at least one of said side walls having:

i) a release leaf having a free end extending away from said top of said cover;

ii) a stop on an inside surface of said side wall and adjacent said free end of said release leaf wherein said free end of said release leaf may swing freely adjacent said stop;

(c) said cover configured such that, once said cover is in place on said body, said free end of said resilient locking leaf and said stop are substantially vertically aligned and said release leaf is substantially adjacent said resilient locking leaf wherein removal of said cover from said body is prevented by said free end of said resilient locking leaf abutting said stop unless said release leaf is forced inward sufficiently to deflect said free end of said resilient locking leaf out of alignment with said stop.

12. A releasable locking mechanism for a container having a cover including an inner surface and an outer surface and a container body including a container body wall, the inner surface being adjacent the container body wall when the cover is closed onto the container body, the locking mechanism comprising:

(a) a stop mounted on the cover interior surface;

(b) a resilient locking leaf formed in said container body wall;

(c) wherein, as the cover is closed onto the container body, said stop deflects said resilient locking leaf inwardly and releases said stop outwardly, said resilient leaf coming to rest directly above said stop such that said resilient locking leaf prevents substantial upward movement of said stop and the container cover; and (d) further comprising a release panel formed in and being substantially coplanar with the outside surface of the cover and positioned adjacent to said stop, said release panel being positioned adjacent to said resilient locking leaf when the cover is closed onto the container body such that when said release panel is pushed inwardly, said panel deflects said resilient locking leaf inwardly of said stop such that said stop can travel freely past said resilient locking leaf.

13. The releasable locking mechanism according to claim 12 wherein the width of said stop is substantially equal to the width of said resilient locking leaf.

14. The releasable locking mechanism according to claim 12 wherein the thickness of said stop is substantially equal to the thickness of said resilient locking leaf.

15. The releasable locking mechanism of claim 12 wherein said container and releasable locking mechanism is formed of corrugated cardboard.

16. A tamper resistant container having a cover including an inside surface and an outside surface and a container body including an inside surface and an outside surface, the container comprising:

(a) a cover including a top wall and opposing side walls and end walls extending downwardly from said top wall, said cover further including an inner surface;

(b) a container body including a floor and opposing side walls and end walls extending upwardly from said floor; and (c) a locking mechanism comprising:

i) a stop mounted on one of said cover side wall interior surfaces;

ii) a resilient locking leaf mounted in an opening formed in one of said container body side walls;

iii) wherein, as the cover is closed onto the container body, said stop deflects said resilient leaf inwardly and releases said stop outwardly, said resilient leaf coming to rest directly above said stop such that said resilient leaf prevents substantial upward movement of said stop and the container cover; and (d) further comprising a release panel formed in and being substantially coplanar with the outside surface of the cover and positioned adjacent to said stop, said release panel being positioned adjacent to said resilient locking leaf when the cover is closed onto the container body such that when said release panel is pushed inwardly, said panel deflects said resilient locking leaf inwardly of said stop such that said stop can travel freely past said resilient locking leaf.

* * * * *